US007695103B2

(12) United States Patent
Nagashima

(10) Patent No.: US 7,695,103 B2
(45) Date of Patent: Apr. 13, 2010

(54) IMAGE FORMING APPARATUS

(75) Inventor: Kanji Nagashima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 272 days.

(21) Appl. No.: 11/092,578

(22) Filed: Mar. 29, 2005

(65) Prior Publication Data

US 2005/0219286 A1 Oct. 6, 2005

(30) Foreign Application Priority Data

Mar. 30, 2004 (JP) ..... 2004-100906

(51) Int. Cl.
*B41J 2/15* (2006.01)
*B41J 29/393* (2006.01)
*B41J 2/045* (2006.01)

(52) U.S. Cl. ..... 347/40; 347/19; 347/68

(58) Field of Classification Search ..... 347/12, 347/19, 40, 68, 71
See application file for complete search history.

(56) References Cited

U.S. PATENT DOCUMENTS

| | | | | |
|---|---|---|---|---|
| 5,650,720 | A * | 7/1997 | Brockmuller et al. | 324/173 |
| 5,734,391 | A * | 3/1998 | Tanaka et al. | 347/14 |
| 5,757,392 | A * | 5/1998 | Zhang | 347/14 |
| 6,257,694 | B1 | 7/2001 | Tokumaru et al. | |
| 6,375,299 | B1 * | 4/2002 | Foster et al. | 347/19 |
| 6,513,902 | B1 | 2/2003 | Amano et al. | |
| 2006/0244777 | A1 | 11/2006 | Paasch | |

FOREIGN PATENT DOCUMENTS

| | | | |
|---|---|---|---|
| JP | 55-118878 | A | 9/1980 |
| JP | 63-141750 | A | 6/1988 |
| JP | 4-29851 | A | 1/1992 |
| JP | 11286124 | A | 10/1999 |
| JP | 11-309874 | A | 11/1999 |
| JP | 11334102 | A | 12/1999 |
| JP | 2001105606 | A * | 4/2001 |

* cited by examiner

*Primary Examiner*—Matthew Luu
*Assistant Examiner*—Jannelle M Lebron
(74) *Attorney, Agent, or Firm*—Birch, Stewart, Kolasch & Birch, LLP

(57) ABSTRACT

The image forming apparatus comprises: a plurality of nozzles; a plurality of liquid supply channels each of which is communicated with a corresponding one of the plurality of nozzles and supplies a liquid to the corresponding one of the plurality of nozzles; a plurality of drive elements each of which applies pressure in the liquid in a corresponding one of the liquid supply channels so as to eject the liquid as a droplet from the corresponding one of the plurality of nozzles; a pressure determination device which is arranged through the plurality of liquid supply channels and determines a pressure of the liquid in each of the liquid supply channels applied by a corresponding one of the plurality of drive elements, the pressure determination device being separated from the plurality of drive elements; and a failed ejection detection device which detects failed ejection of the droplet from each of the plurality of liquid supply channels according to the pressure determined by the pressure determination device.

28 Claims, 9 Drawing Sheets

IMAGE FORMING APPARATUS

BACKGROUND OF THE INVENTION

1. Field of the Invention

The present invention relates to an image forming apparatus, and more particularly to an image forming apparatus comprising a droplet ejection head in which a failed ejection detection unit for detecting failed ejections is embedded.

2. Description of the Related Art

Conventionally, one known example of an image forming apparatus is an inkjet recording apparatus (inkjet printer) that has an inkjet head (ink discharge head) with an alignment of multiple nozzles and that forms an image on a recording medium by discharging ink (ink droplets) from the nozzles while moving the inkjet head and the recording medium relative to each other.

Various methods are known in conventional practice as ink ejection methods for such an inkjet recording apparatus. Known examples include a piezoelectric system wherein a vibration plate that constitutes part of a pressure chamber (ink chamber) is deformed by the deformation of a piezoelectric element (piezoelectric ceramics), the capacity of the pressure chamber is changed, ink is led into the pressure chamber from an ink supply channel during this increase in pressure chamber capacity, and the ink in the pressure chamber is ejected as droplets during the decrease in pressure chamber capacity. Further, known examples also include a thermal inkjet system wherein ink is heated to create air bubbles for ejecting the ink by the expansion energy when the air bubbles grow.

In image forming apparatuses that have ink ejection heads such as an inkjet recording apparatus, ink is supplied from an ink storage tank to ink ejection heads via an ink supply channel, and the ink is ejected by the various ejection methods described above, but ejection must be stabilized so that the amount of ink ejected, the rate of ejection, the direction of ejection, and the shape (volume) of the ejected ink and the like are always constant.

However, during printing, the nozzles of the ink ejection heads are always filled with ink so that printing can be immediately performed upon receiving a print command, and the ink in the nozzles is exposed to air; therefore, the ink in the nozzles dries when it is not ejected for a long period of time, the viscosity of the ink increases, rigid ink droplets cannot be ejected, and the nozzles clog, which sometimes results in failed ejections. Also, the refilling of ink is sometimes slowed and unsatisfactory ejections may occur due to the accumulation of the air bubbles that are mixed in the ink supply channel or the like and block the supply of ink, or due to continuing ejections over a long period of time.

These reasons are the causes of failed ejection as described above, and maintenance must be performed on the ejection heads when stable ink ejection is no longer possible. In view of this, various methods have been proposed in conventional practice for determining whether ink has been ejected in a stable manner or if the ejection heads have failed to eject ink.

In one known example, a determination device is disposed for determining the state of displacement of a vibration element that varies the capacity in the ink chamber according to an electrical signal in order to discharge ink from ink droplet discharge ports, and the displacement of the vibration element has a high-frequency vibration component when air is mixed in the ink chambers during the recording operation. Therefore, irregularities in the state of displacement of the vibration element are detected by determining the displacement and identifying the state of failed ejection of the ink (for example, see Japanese Patent Application Publication No. 55-118878).

Another known example is a failed ejection detection method that uses an inverse analysis technique of signal processing, which involves a drive circuit for a piezoelectric element and a circuit for adjusting the vibration waveform during the driving of the piezoelectric element, wherein the high frequency components of the vibration waveform of the piezoelectric element are converted to pulses and extracted, the repeating cycle of the vibration waveform is determined, and the presence or absence of air bubbles in the ink chambers or the state of unfilled ink or the like is determined from the variations in this cycle (for example, see Japanese Patent Application Publication No. 63-141750).

Also, the capacity of the pressure chambers rapidly decreases when the piezoelectric elements are driven by a pulse signal, ink particles are ejected from orifices (ink ejection ports), and the pressure chambers return to their original states when the pulse signal is no longer applied, but the vibration of the ink produced at this time is transmitted to the piezoelectric element and the piezoelectric element creates an electrical signal.

In view of this, in another known example, an inverse analysis technique of signal processing is performed to a higher degree so that the output signal of the piezoelectric element is determined, and at least one of either the extent of the vibration damping time and the peak value range of the output signal is observed to determine which of the pressure chambers or ink chambers contain the air bubbles (for example, see Japanese Patent Application Publication No. 4-29851).

Another known example has a pressure measuring device for determining the internal pressure of the ink supply channel in addition to the piezoelectric element for creating pressure to eject ink, in which a failed ejection detection unit is used to observe the variation in the voltage produced by the deformation of the piezoelectric element due to internal pressure variation in the ink supply channel immediately after ink has been ejected, ejection/failed ejection is determined based on the variations in the voltage produced, and the internal pressure of the ink supply channel as determined by the pressure measuring device is controlled by a pressurizing device on the basis of a failed ejection signal so as to reach a set pressure value, whereby a failed ejection recovery operation is performed (for example, see Japanese Patent Application Publication No. 11-286124). In addition, the example described in Japanese Patent Application Publication No. 11-286124 has a buffer chamber that separates air bubbles in order to prevent the air bubbles from being mixed in the ink.

In another known example, as a developing technique of inverse analysis, an actuator (vibration inducing element) and a reflecting plate are provided to the opposite sides constituting the ink chamber so as to come into direct contact with the ink in the ink chamber, the vibration caused by the actuator is propagated into the ink, and the vibration reflected by the reflecting plate facing the actuator and returned back to the actuator is determined, whereby debris or air bubbles mixed in the ink chamber are detected (for example, see Japanese Patent Application Publication No. 11-309874).

Additionally, as a typical example of an inverse analysis technique, the impedance at an arbitrary frequency of the piezoelectric element in the head is measured, frequency characteristics of the impedance are created, and the frequency characteristics are used to determine whether air bubbles have adhered to the piezoelectric element (for example, see Japanese Patent Application Publication No. 11-334102).

However, the example disclosed in Japanese Patent Application Publication No. 55-118878 has another determination device provided to the vibration element to determine the displacement of the vibration element, but with either a piezoelectric member with a bimorph structure or a push rod-type piezoelectric member, forming more than the minimum intervals necessary to manufacture the vibration element results in portions in which the pressure is lost, which is undesirable for efficiently producing force (pressure) for ejecting ink.

This drawback is particularly pronounced when a high-density head is manufactured. Also, generally the size of the driving element should be taken into greater consideration than the size of the determination element in terms of the function of creating an ink ejection force, but since there is a limit on how small the determination element can be, problems are encountered in that the difference in size between the determination element and the drive element decreases, the ratio of the vibration plate covered by the drive element further decreases as a result, there is a greater loss in force created (pressure) by the drive element, and, depending on the situation, the created force may not be sufficient for ejection.

The examples described in Japanese Patent Application Publication Nos. 63-141750, 4-29851, and 11-334102 are designed to detect failed ejection using a system referred to as an inverse analysis technique that also uses the drive element as the determination element. According to this system, using the drive element itself for ejecting ink as a determination element is advantageous in that no new components are needed, but it has a basic problem in that the drive signal and the determination signal must be separated.

Other problems are encountered in that determination is difficult to perform the moment the drive force for ink ejection is produced because the drive signal suddenly changes and the amplitude becomes too great, resulting in determination results being produced at times other than ejection, which causes the time in which determination is possible to be limited and also limits the information that can be obtained by such a determination; therefore, precise determination is not possible.

The example described in Japanese Patent Application Publication No. 11-309874 can also be considered a developing technique of inverse analysis, designed so that vibration is reflected by another member, it is determined when the vibration has returned to the drive element with a time difference, but the strength of the reflectivity of the reflective surface in contact with the ink must be increased to a certain extent with consideration for the strength of the reflected wave. Also, in order to separate the drive signal and the determination signal, the pulse range (time) of the drive signal and the distance between the drive element and the reflective plate must be increased so as to allow the time difference needed to separate these signals, which creates restrictions on the drive signal waveform and the dimensions of the ink pressure chambers, and these restrictions become more severe when ink is ejected at high speeds. Consequently, problems are encountered in that it is difficult to achieve this configuration, particularly in a high-density head wherein the pressure chambers have been reduced in size.

The example described in Japanese Patent Application Publication No. 11-286124 determines the internal pressure changes in the ink supply channel, which is a problem in that it is unsuitable for detecting pressure irregularities during discharge.

Furthermore, in any of the conventional techniques described above, particularly in a matrix-type head, which is a high density head spanning the page width, no suitable configuration is provided for detecting failed ejections.

SUMMARY OF THE INVENTION

The present invention has been contrived in view of such circumstances, and an object thereof is to provide an image forming apparatus wherein a plurality of pressure chambers are determined by one determination device, and ejection irregularities can be detected without relying on the timing of a drive signal.

In order to attain the aforementioned object, the present invention is directed to an image forming apparatus, comprising: a plurality of nozzles; a plurality of liquid supply channels each of which is communicated with a corresponding one of the plurality of nozzles and supplies a liquid to the corresponding one of the plurality of nozzles; a plurality of drive elements each of which applies pressure in the liquid in a corresponding one of the liquid supply channels so as to eject the liquid as a droplet from the corresponding one of the plurality of nozzles; a pressure determination device which is arranged through the plurality of liquid supply channels and determines a pressure of the liquid in each of the liquid supply channels applied by a corresponding one of the plurality of drive elements, the pressure determination device being separated from the plurality of drive elements; and a failed ejection detection device which detects failed ejection of the droplet from each of the plurality of liquid supply channels according to the pressure determined by the pressure determination device.

According to the present invention, it is possible to use a single pressure determination device in determining the pressure of the liquid in the plurality of liquid supply channels communicated with the nozzles with. As a result, the number of components is reduced and costs are reduced, and it is possible to improve the precision with which the device is arranged, to reduce discrepancies between determination elements, and to further improve the precision of determination.

Preferably, the pressure determination device includes one of a flat plate-shaped pressure determination sensor and a rod-shaped pressure determination sensor configured from a piezoelectric element. According to this, the mechanical-electrical conversion efficiency is improved, a configuration in which the pressure in a plurality of liquid supply channels is determined by a single pressure determination device can be easily formed, the apparatus is easily handled during assembly, the apparatus can be reduced in size, and assembly can be improved.

Preferably, the liquid supply channels include pressure chambers provided with the plurality of drive elements. It is thereby possible to detect failed ejections of liquid by determining the pressure of the liquid in the pressure chambers.

Preferably, the plurality of pressure chambers are arranged two-dimensionally; and at least one of the plurality of pressure chambers is provided with a plurality of the pressure determination devices. The precision of determination can thereby be improved.

Preferably, the pressure determination device determines the pressure of the liquid applied by each of the plurality of drive elements being driven with a specific waveform. The precision with which failed ejections are detected can be improved by determining the pressure resulting from driving with a waveform that is different from the driving waveform during ejection.

In order to attain the aforementioned object, the present invention is also directed to an image forming apparatus, comprising: a plurality of nozzles; a plurality of liquid supply channels each of which is communicated with a corresponding one of the plurality of nozzles and supplies a liquid to the corresponding one of the plurality of nozzles; a plurality of drive elements each of which applies pressure in the liquid in a corresponding one of the liquid supply channels so as to eject the liquid as a droplet from the corresponding one of the plurality of nozzles; a pressure determination device which is arranged through the plurality of liquid supply channels and determines a pressure of the liquid in each of the liquid supply channels applied by a corresponding one of the plurality of drive elements, the pressure determination device being separated from the plurality of drive elements; an individual signal extraction device which is operatively connected to the pressure determination device and extracts a pressure determination result from the pressure determination device for each of the plurality of liquid supply channels; and a failed ejection detection device which detects failed ejection of the droplet from each of the plurality of liquid supply channels according to the pressure determination result determined for a corresponding one of the plurality of liquid supply channels.

According to the present invention, it is possible to easily determine the pressure in each of the plurality of liquid supply channels with a single pressure determination unit.

In order to attain the aforementioned object, the present invention is also directed to an image forming apparatus, comprising: a plurality of nozzles; a plurality of liquid supply channels each of which is communicated with a corresponding one of the plurality of nozzles and supplies a liquid to the corresponding one of the plurality of nozzles; a plurality of drive elements each of which applies pressure in the liquid in a corresponding one of the liquid supply channels so as to eject the liquid as a droplet from the corresponding one of the plurality of nozzles; a drive control device which controls a timing at which each of the plurality of drive elements is driven for the corresponding one of the liquid supply channels; a pressure determination device which is arranged through the plurality of liquid supply channels and determines a pressure of the liquid in each of the liquid supply channels applied by the corresponding one of the plurality of drive elements, the pressure determination device being separated from the plurality of drive elements; and a failed ejection detection device which detects failed ejection of the droplet from each of the plurality of liquid supply channels according to the pressure determined by the pressure determination device, wherein the plurality of drive elements are driven with time differences with respect to each other by the drive control device, and the failed ejection is detected for a corresponding one of the liquid supply channels by the failed ejection detection device according to a pressure determination result obtained by the pressure determination device and extracted for the corresponding one of the liquid supply channels.

According to the present invention, it is possible to use a single pressure determination unit to easily determine the pressure similarly in each of a plurality of liquid supply channels.

Preferably, the image forming apparatus further comprises an outside-head failed ejection detection device which detects the ejected droplet. According to this, the precision with which failed ejections are detected can be improved by including two failed ejection detection units, one inside the head and one outside the head.

As described above, with the image forming apparatus in accordance with the present invention, a single pressure determination unit separate from the drive element for ejecting droplets from the nozzles is provided for a plurality of liquid supply channels. It is therefore possible to determine the pressure in a plurality of liquid supply channels with a single pressure determination unit, and to detect ejection irregularities without relying on the timing by which the drive element for ejecting droplets from the nozzles is driven.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

The present embodiment in particular uses a matrix-type head, which is a head with a high density along the page width, wherein a device for detecting failed ejections (an inside-head failed ejection detection unit) is embedded in the head, irregularities (failed ejections) occurring in the pressure chambers for discharging droplets are effectively detected, another device for detecting failed ejections by another method (an outside-head failed ejection detection unit) is provided outside of the head, and failed ink ejections are more precisely detected by using both of these two failed ejection detection units.

Figure 1:
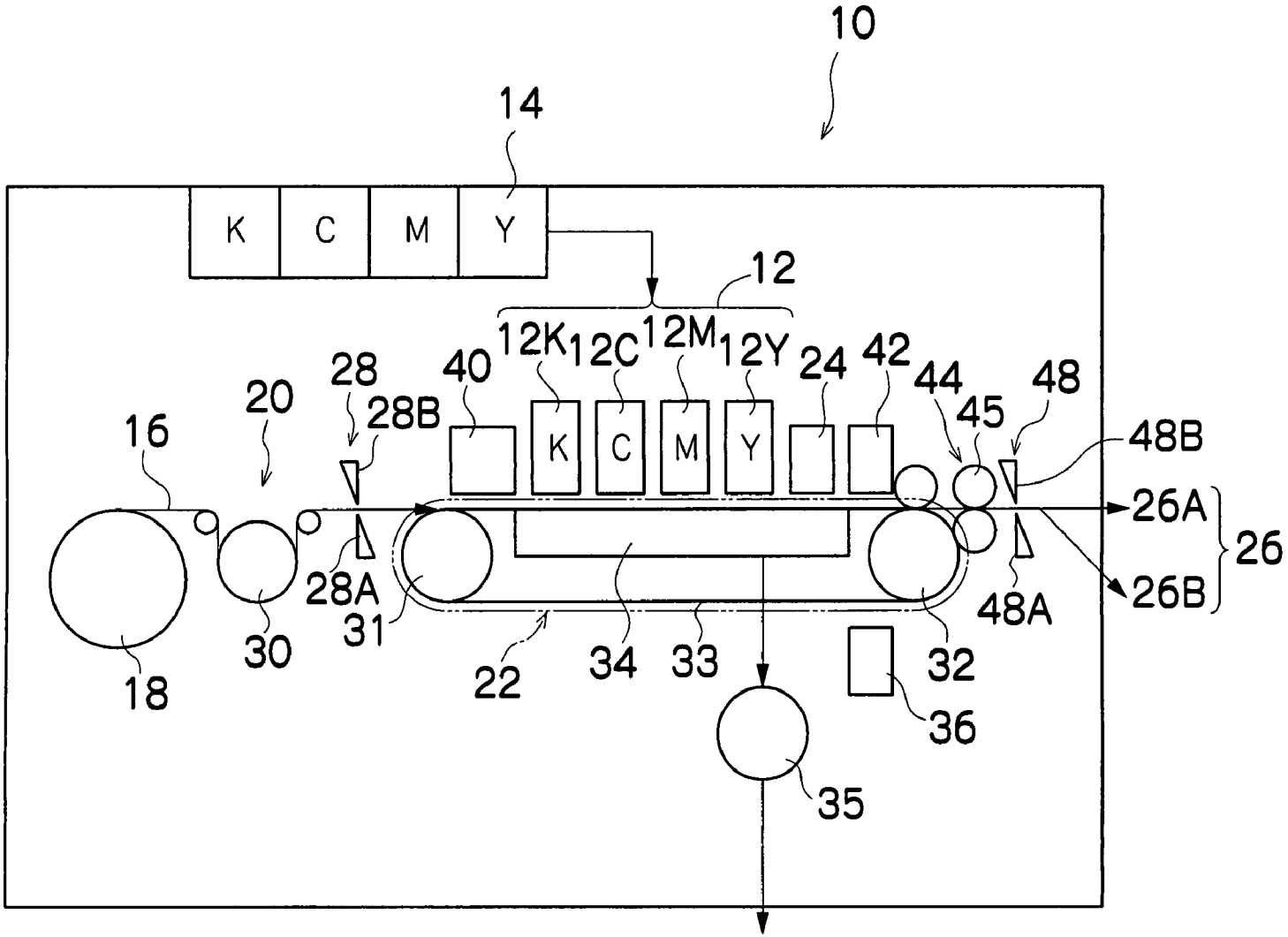
FIG. 1 is a general schematic drawing of an inkjet recording apparatus according to an embodiment of the present invention.

FIG. 1 is a general schematic drawing showing an inkjet recording apparatus as one example of such an image forming apparatus.

As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; an outside-head failed ejection detection unit 24 for detecting failed ejections outside the head whereby the failed ink ejections outside of the printing unit 12 are detected; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 forms a horizontal plane (flat plane).

The belt 33 has a width that is greater than the width of the recording paper 16, and a plurality of suction apertures (not shown) are formed on the belt surface. A suction chamber 34 is disposed in a position facing the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
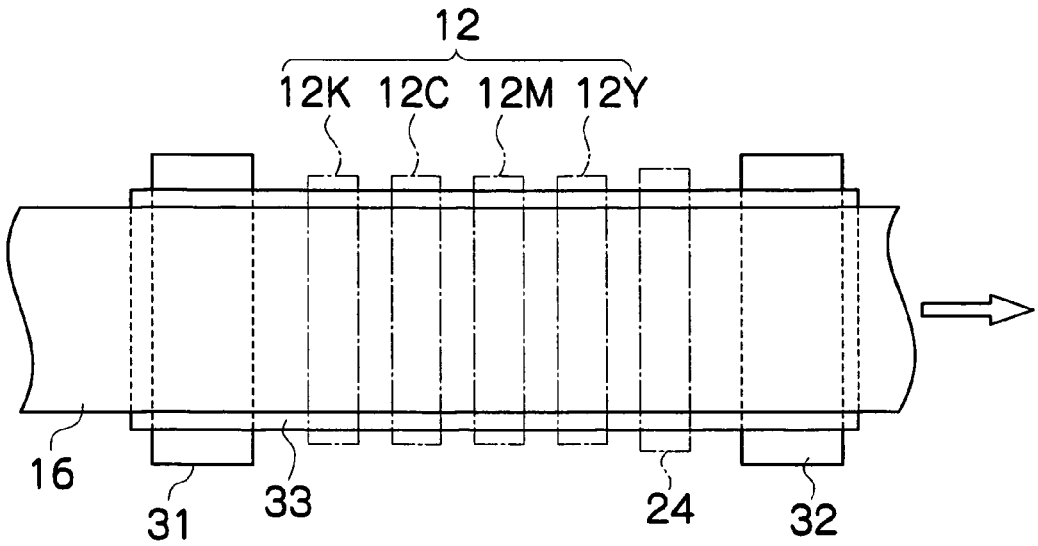
FIG. 2 is a plan view of principal components of an area around a printing unit of the inkjet recording apparatus in FIG. 1.

FIG. 2 is a plan view of principal components of an area around a printing unit 12 of the inkjet recording apparatus 10 in FIG. 1.

As shown in FIG. 2, the printing unit 12 includes the print heads 12K, 12C, 12M, and 12Y corresponding to four ink colors (KCMY), and forms a so-called full-line head in which each of the print heads 12K, 12C, 12M, and 12Y is disposed in the paper width direction (main scanning) perpendicular to the paper conveyance direction (sub-scanning) among a length that corresponds to the maximum paper width by arranging a plurality of ink-droplet ejection apertures (nozzles) along a length that exceeds at least one side of the maximum-size recording paper 16. Although the structure is not described later, each of the print heads 12K, 12C, 12M, and 12Y is provided with various devices for determining the ink discharge condition, the discharged ink-droplet size, the ink-ejecting speed, or the like (for example, a detection unit for detecting the ink discharge, an optical system for forming a luminous flux for determination in a desired shape, and the like).

As shown in FIG. 2, each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The outside-head failed ejection detection unit 24 is provided to the exterior of the printing unit 12 and is designed for detecting ejection failures outside of the printing unit 12 by directly detecting the presence or absence of ink. The specific configuration thereof is not particularly limited. Examples of possibilities are a method wherein the ink discharged from the print heads 12K, 12C, 12M, and 12Y and in midair is detected by laser light, and a method wherein the ink that strikes the recording paper 16 after ejection is scanned and detected by a CCD or another such image scanning sensor.

In a method wherein the ink in midair is detected by laser light, an optical system for forming a luminous flux of laser light and a sensor for receiving this light are installed in the space where the ink is flying between the print heads 12K, 12C, 12M, and 12Y and the recording paper 16, and the presence or absence of ink is determined to detect failed ink ejections by detecting the change in the amount of light when ink traverses the laser luminous flux.

According to this method, the location of ink in midair can actually be confirmed and it is also possible to determine the direction in which the ink is flying; therefore, it is possible not only to detect failed ejections, but also to detect turns in the direction in which the ink is flying.

The method for detecting failed ejections by scanning ink that has struck the recording paper 16 includes an image sensor (line sensor or the like) for photographing the droplet ejection results of the printing unit 12, and is intended to check for nozzle clogging and other ejection problems from the droplet ejection image scanned by the image sensor. This image sensor is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements, which are arranged two-dimensionally.

For example, the image sensor at the measurement reads a test pattern printed with the print heads 12K, 12C, 12M, and 12Y for the respective colors, and the ejection of each head is determined. The ejection determination includes the presence of the ejection, measurement of the dot size, and measurement of the dot deposition position.

In the method for detecting failed ejections by scanning the image of the printing result, the location of ink on the actual printed object can be determined; therefore, curvature of the direction that the ink is flying can also be reliably determined.

A post-drying unit 42 is disposed following the printing unit 12 and the outside-head failed ejection detection unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in the diagram, a sorter for collecting prints according to print orders is provided to the paper output unit 26A for the target prints.

Next, the structure of the print heads is described. The print heads 12K, 12C, 12M and 12Y have the same structure, and a reference numeral 50 is hereinafter designated to any of the print heads 12K, 12C, 12M and 12Y.

Figure 3:
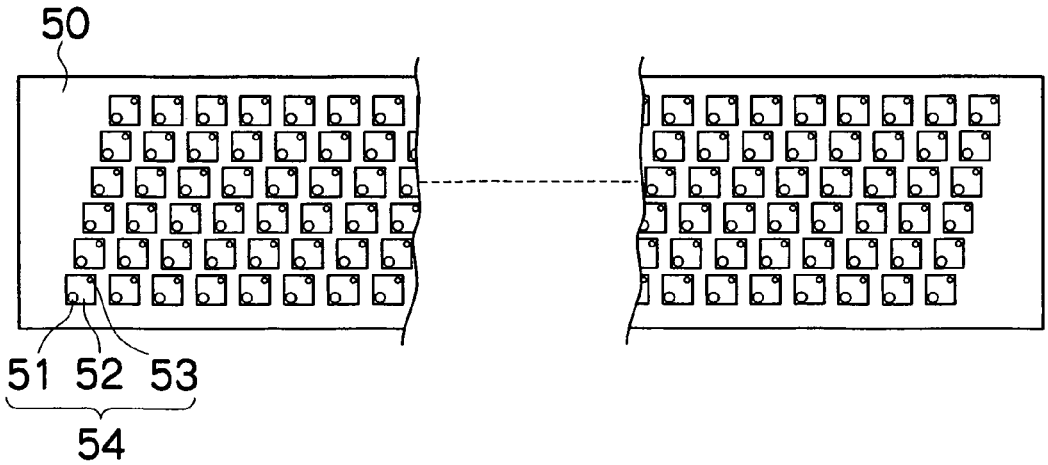
FIG. 3 is a perspective plan view showing another example of the configuration of the print head.

FIG. 3 is a perspective plan view showing an example of the configuration of the print head 50.

As shown in FIG. 3, the print head 50 of the present embodiment has two-dimensionally aligned pressure chamber units 54, which are each configured including a nozzle 51 for ejecting ink, a pressure chamber 52 for applying pressure to the ink when the ink is ejected, and a supply port 53 for supplying ink to the pressure chamber 52 from a common flow channel (not shown). This configuration makes it possible to increase the density of nozzles 51.

FIG. 3 schematically depicts the arrangement of the nozzles 51 in the print heads 50, wherein only six rows of nozzles 51 are displayed in the transverse direction, but in practice, the total number of pressure chambers 52 aligned at a high density in both directions at intervals of about 0.5 mm, for example, is 28800 for each color (12 inches at 2400 dpi).

As shown in FIG. 3, the pressure chambers 52 have a substantially square shape as seen from above, wherein nozzles 51 are formed at one end of the diagonal, and ink supply ports 53 are formed at the other end. Though described in detail later, at least one wall of each pressure chamber 52 (for example, the surface opposite that on which the nozzle 51 is formed) is configured from a freely deformable vibration plate and is deformed by an actuator driven with an electrical signal, the capacity of the pressure chambers 52 is reduced by the deformation of the vibration plate and the application of pressure to the ink in the pressure chamber 52, and the ink is ejected from the nozzle 51.

At this time, sometimes the ink is not ejected suitably or is not ejected at all if the ink increases in viscosity or if air bubbles are mixed in the ink. In the present embodiment, as previously described, the outside-head failed ejection detection unit 24 is provided outside of the printing unit 12, a sensor for determining pressure (pressure determination means) in the pressure chamber 52 is embedded as an inside-head failed ejection detection unit that is designed to determine the pressure of the ink in the pressure chamber 52, and failed ejections of ink are reliably detected by using both these two failed ejection detection means.

Next, the sensor (pressure determination means) embedded in the apparatus will be described. In the present embodiment, a flat plate-shaped sensor and a long, thin rod-shaped sensor are employed as the sensors (pressure determination means) because they can be easily embedded within the head.

Figure 4A:
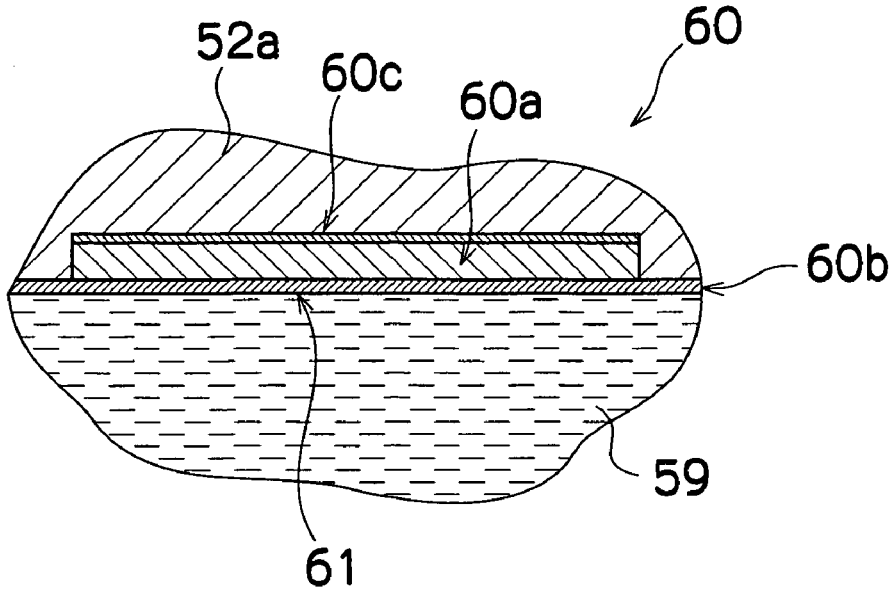
FIG. 4A is a cross-sectional view showing the structure of a flat-plate sensor.
Figure 4B:
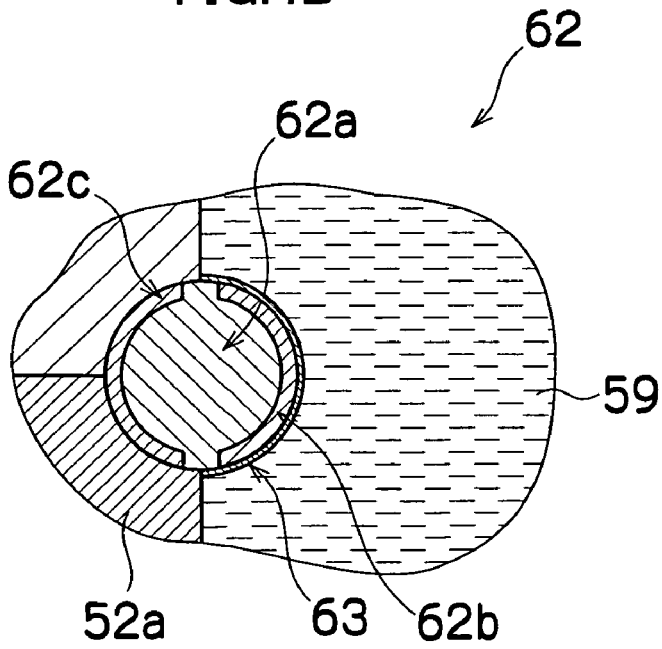
FIG. 4B is a cross-sectional view showing the structure of a rod-type sensor.

FIGS. 4A and 4B show the schematic configurations of sensors (pressure determination means). FIGS. 4A and 4B show the state of a sensor embedded in the inner wall 52*a* of a pressure chamber 52 so as to directly determine ink pressure. FIG. 4A is a cross-sectional view in a direction perpendicular to the sensor surface in a flat plate-shaped sensor, and FIG. 4B is a cross-sectional view in a direction perpendicular to the longitudinal direction of a long, thin rod-shaped sensor.

As shown in FIG. 4A, the flat plate-shaped sensor 60 is embedded in the inner wall 52*a* so that a determination piezoelectric element 60*a* formed into a flat plate shape for determining pressure is parallel to the inner wall 52*a* of the pressure chamber 52, and the front surface thereof is subjected to the pressure of the ink 59. A sheet-shaped piezo or PZT element or the like, for example, can be suitably used as the determination piezoelectric element 60*a*. Electrodes 60*b* and 60*c* are formed on the surface of the determination piezoelectric element 60*a* on the side of the ink 59 and on the opposite surface thereof, respectively. A protective layer 61 is also provided to the surface of the electrode 60*b* in contact with the ink 59. Also, in the case of multiple flat plate-shaped sensors 60 comprising such determination piezoelectric elements 60*a* and electrodes 60*b* and 60*c*, these two electrodes 60*b* and 60*c* can determine the pressure in each pressure chamber 52 by using one as a common electrode electrically connected to the electrodes of each piezoelectric element 60*a*, and the other as an individual electrode for driving each piezoelectric element 60*a* separately. For example, the electrode 60*b* on the side facing the ink 59 my be used as the common electrode, while the electrode 60*c* on the opposite side may be used as the individual electrode.

When the determination piezoelectric element 60*a* is subjected to the pressure from the ink 59 and is deformed, a voltage is produced according to the strain. The voltage produced by the determination piezoelectric element 60*a* is removed by the electrodes 60*b* and 60*c*. As described in detail later, one such flat plate-shaped sensor 60 is provided in common to each of a plurality of pressure chambers 52, the electrode 60*b* is used as a common electrode for the plurality of pressure chambers 52, and the electrode 60*c* is used as an individual electrode acting on each pressure chamber 52, whereby the voltage produced by each pressure chamber 52 can be determined separately.

Otherwise, if one such determination piezoelectric element 60*a* is provided in common to a plurality of pressure chambers 52, it is possible to perceive which pressure chamber 52 is producing the currently determined voltage by driving each pressure chamber 52 at different times using both electrodes 60*b* and 60*c* of the determination piezoelectric element 60*a* as common electrodes, whereby each pressure chamber 52 may be differentiated and the voltage produced by each pressure chamber 52 can be determined separately. Such a method of determining pressure will be described in detail later.

Also, as shown by the cross section perpendicular to the longitudinal direction in FIG. 4B, a rod-shaped sensor 62 is embedded in the inner wall 52*a* so that a pillar-shaped determination piezoelectric element 62*a* is longitudinally parallel to the inner wall 52*a* of the pressure chamber 52, and the side surface thereof is subjected to pressure from the ink 59. A suitable example of the rod-shaped sensor 62*a* is a composite piezoelectric material wherein a piezoelement has been made into a fiber and hardened by a resin. Electrodes 62*b* and 62*c* are formed at fixed intervals between each electrode on the side of the rod-shaped sensor 62*a* facing the ink 59 and on the opposite side embedded in the inner wall 52*a*, respectively. Also, a protective layer 63 is provided to the front surface of the electrode 62*b* in contact with the ink 59. The pressure in each pressure chamber 52 can be determined by using one of these two electrodes 62*b* and 62*c* as a common electrode and the other as an individual electrode, similar to the flat plate-shaped sensor 60 described above. For example, the electrode 62*b* on the side facing the ink 59 may be used as the common electrode, while the electrode 62*c* on the opposite side embedded in the inner wall 52*a* may be used as the individual electrode.

A piezoelectric element is used to determine pressure herein, but this is not necessarily limited to a piezoelectric element, and it is possible to utilize another arbitrary pressure determination sensor. Also, the shape of the sensor (pressure determination sensor) may be a suitable partial variation from the plate shape or rod shape as long as it is within a range that does not compromise the ease of handling or ease of assembly.

Next, the method of disposing such a sensor (pressure determination sensor) in the pressure chambers 52 arranged in a two-dimensional matrix configuration on the print head 50 will be described.

FIGS. 5A to 5E show an example of the method for arranging such a sensor on the print head 50.

Figure 5A:
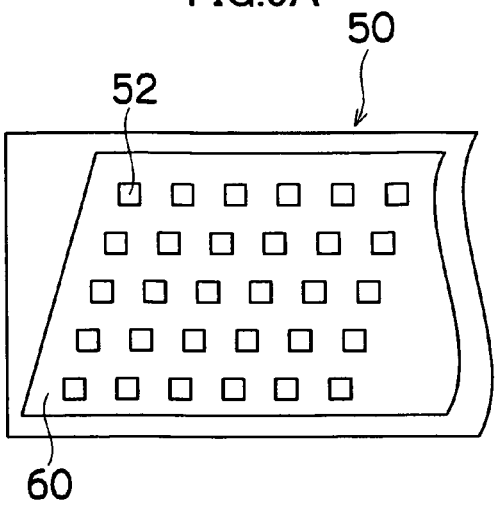
FIGS. 5A to 5E are plan views showing examples of arranging the pressure determination means.

In the method shown in FIG. 5A, one flat plate-shaped sensor 60 is provided for all the pressure chambers 52 disposed in a two-dimensional matrix configuration on the print head 50.

Figure 5B:
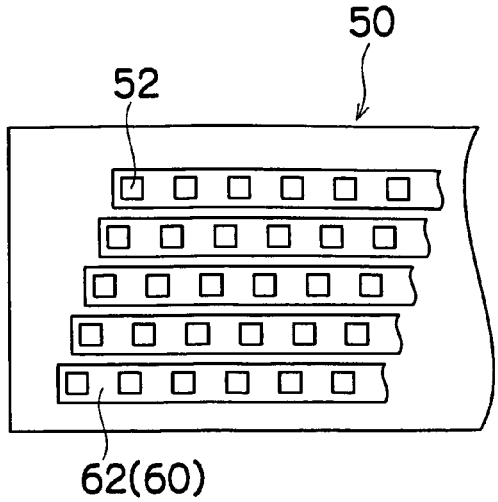

In the method shown in FIG. 5B, one rod-shaped sensor 62 for each row of pressure chambers 52 arranged in a two-dimensional matrix configuration on the print head 50 (each arrangement of pressure chambers 52 aligned in the transverse direction in the diagram) is arranged through the pressure chambers 52. At this time, the sensors provided through the pressure chambers 52 may be flat plate-shaped sensors 60 formed into long, thin rectangular shapes.

Figure 5C:
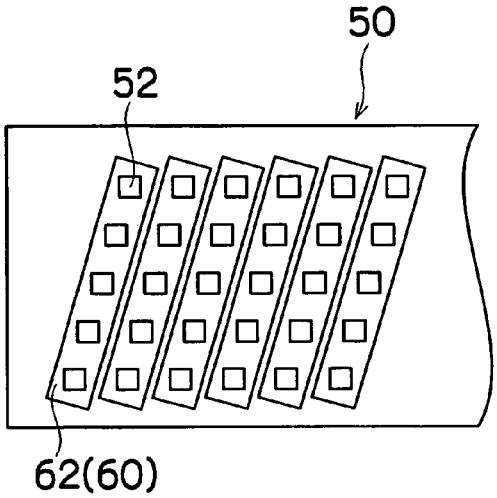

Also, in FIG. 5C, one rod-shaped sensor 62 (or flat plate-shaped sensor 60 formed into a rectangle shape) is provided for each row of pressure chambers 52 arranged in a two-dimensional matrix configuration (each arrangement of pressure chambers 52 aligned in the longitudinal direction in the diagram) opposite that in FIG. 5B.

Figure 5D:
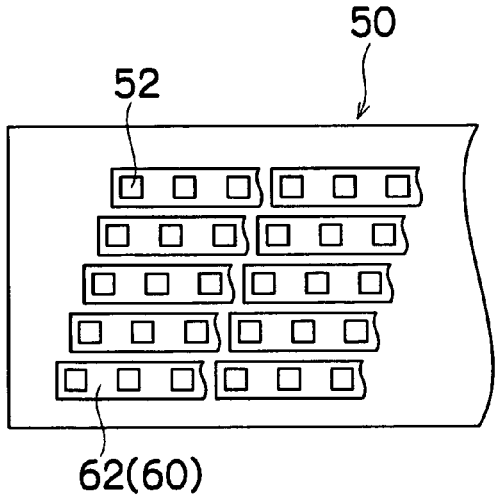

In FIG. 5D, the pressure chambers 52 arranged in a two-dimensional matrix configuration are divided into groups of several to several dozen pressure chambers 52 (groups of three in the diagram), and one (for example) rod-shaped sensor 62 is provided for each group of pressure chambers 52.

Figure 5E:
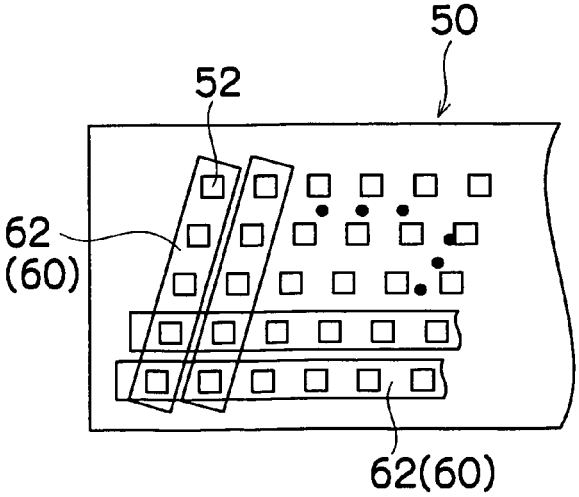

These sensor arrangements are not limited to only one, and a combination of these arrangements may be used. For example, FIG. 5E is a combination of FIGS. 5B and 5C. At this time, the pressure chambers 52 have two sensors, one in the direction of the columns and one in the direction of the rows, and the precision for performing determination with these two sensors is improved.

As shown in FIGS. 5A to 5D, when one sensor is provided for a plurality of pressure chambers 52, it becomes necessary to differentiate between the pressure chambers 52, and although there is a possibility that the S/N ratio of the signals will be difficult to improve, the number of wires can be reduced. Examples of the method for differentiating between the pressure chambers 52 include a method of electrode separation wherein the pressure chambers 52 are differentiated by extracting voltage signals corresponding to each pressure chamber 52 using one of the electrodes 60*c* or 62*c* as a separate electrode for extracting the voltage produced by the determination piezoelectric elements 60*a* and 62*a*, and a separation method that relies on a time difference wherein the determined voltage signals are differentiated relative to the pressure chambers 52 by driving the pressure chambers 52 with a time difference using the electrodes 60*b*, 60*c* and 62*b*, 62*c* on either sides of the determination piezoelectric elements 60*a* and 62*a*.

When one sensor is used for all the pressure chambers 52 in one print head 50 as in FIG. 5A, it is difficult to differentiate between the pressure chambers 52, but the number of wires can be reduced to as few as possible. Also, when one sensor is provided for one column or one row as shown in FIGS. 5B and 5C, it is believed that it is practical for signal differentiation to provide one sensor for a plurality of adjacent pressure chambers as shown in FIG. 5D, out of consideration for wiring and assembly.

FIGS. 6A to 6E show examples of the manner in which the sensor is embedded in the pressure chamber 52.

In FIGS. 6A to 6E, 51 is a nozzle, 52 is a pressure chamber, 56 is a vibration plate, 58 is an ejection piezoelectric element (drive piezoelectric element) for deforming the vibration plate 56 and ejecting ink from the nozzle 51, and 59 is the ink ejected from the nozzle 51. These diagrams show the manner in which the previously described flat plate-shaped sensor 60 and the rod-shaped sensor 62 are embedded.

Figure 6A:
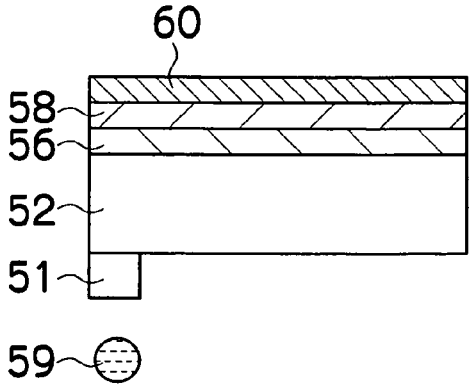
FIGS. 6A to 6E are cross-sectional views showing examples of the manner in which the pressure determination means are embedded.

FIG. 6A shows the flat plate-shaped sensor 60 provided on top of the ejection piezoelectric element 58 (the surface opposite the vibration plate 56). In this case, since the flat plate-shaped sensor 60 is provided on top of the ejection piezoelectric element 58, the deformation of the ejection piezoelectric element 58 is determined as a result. In this arrangement, the S/N ratio is difficult to improve.

Figure 6B:
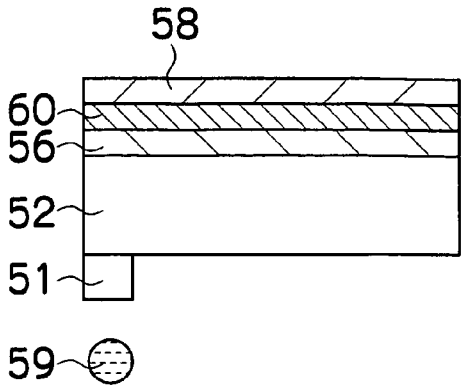

FIG. 6B shows the flat plate-shaped sensor 60 provided between the vibration plate 56 and the ejection piezoelectric element 58. This arrangement is disadvantageous in that because the flat plate-shaped sensor 60 is formed between the ejection piezoelectric element 58 and the vibration plate 56, it is difficult for the power produced by the ejection piezoelectric element 58 to be transmitted through the vibration plate 56 to the ink in the pressure chamber 52.

Figure 6C:
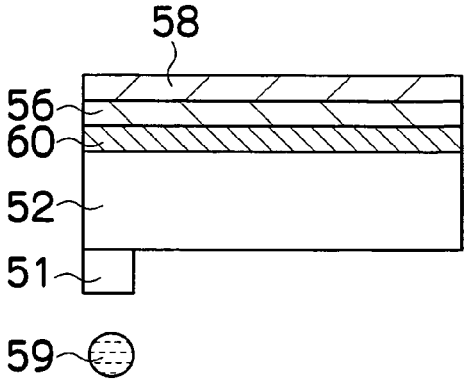

Also, FIG. 6C shows the flat plate-shaped sensor 60 provided to the vibration plate 56 on the side with the pressure chamber 52, specifically, on the side of the vibration plate 56 in contact with the ink. In this case, the flat plate-shaped sensor 60 determines a signal resulting from adding the ink pressure and the deformation of the vibration plate 56.

Figure 6D:
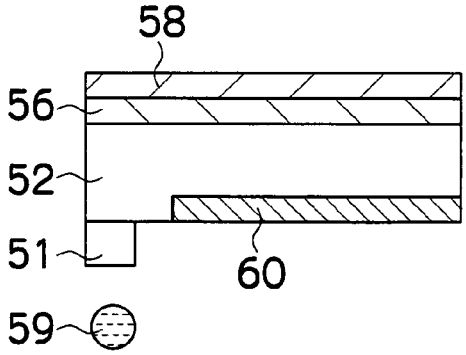

FIG. 6D shows the flat plate-shaped sensor 60 provided to the bottom surface of the pressure chamber 52, specifically, to the surface facing the vibration plate 56 (the surface of the side on which the nozzle is formed). In this case, a signal is determined for the ink pressure in the pressure chamber 52.

Figure 6E:
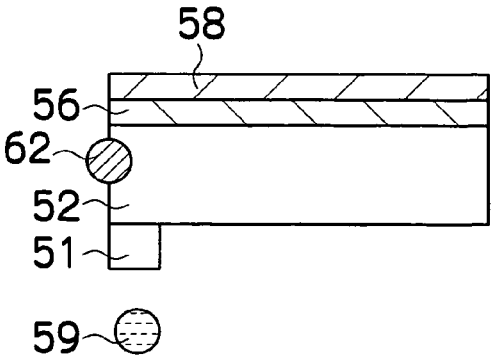

Also, FIG. 6E shows the rod-shaped sensor 62 embedded in the inner wall of the pressure chamber 52 near the nozzle 51 and skewering the pressure chamber 52. In this case as well, a signal is determined for the ink pressure in the pressure chamber 52.

Of the embedding methods described above, the configuration in FIG. 6C is preferable, and the most preferred configurations are those shown in FIG. 6D and FIG. 6E.

Also, due to the use of a configuration with a sensor disposed in this manner, the sensor is easily embedded in a layered head in which a thin stainless-steel plate is layered. Furthermore, the number of components can be reduced, which is extremely beneficial for manufacturing.

Also, various methods can be used and are not particularly limited for extracting a voltage signal from the electrodes 60*c* and 62*c* for determining the voltage produced by the deformation of the determination piezoelectric elements 60*a* and 62*a* due to ink pressure.

For example, other possibilities include a case in which the wiring for extracting the pressure-determining voltage signal is wired separately from the wiring (actuator wiring) for applying voltage to the ejection piezoelectric element 58 for driving the pressure chambers 52, a case in which the wiring is placed on the side of the ejection piezoelectric element 58 (the top side of the pressure chamber 52 as shown in FIGS. 6A to 6E, for example), and a case in which the wiring is placed on the side of the nozzle 51 (the bottom side of the pressure chamber 52).

At this time, when wiring is performed from the side of the ejection piezoelectric element 58, the result is the same side as the actuator wiring, so the wiring density is a multiple of the actuator wiring alone. When wiring is performed from the side of the nozzle 51, the wiring is performed from the bottom side of the pressure chamber 52, so actuator wiring is placed on the top side of the pressure chamber 52 and the wiring is formed on both sides of the pressure chamber 52.

Also, when the actuator wiring is also used as wiring for extracting the drive signal for determining pressure, if the pressure is determined while the pressure chambers 52 are driven and ink is ejected, it is believed that it is difficult to simultaneously determine the pressure during driving because the size of the signal is originally different from the drive signal for ejection.

Also, when one flat plate-shaped sensor 60 is provided for all the pressure chambers 52 in the print head 50, as shown in FIG. 5A, for example, it is possible to ensure that a pressure determination signal for each pressure chamber 52 can be extracted by forming two-dimensional wiring in both the longitudinal and transverse directions, assigning addresses thereto, performing switching for each pressure chamber 52, and driving the chambers in a matrix fashion similar to a so-called liquid crystal display device. In this case, one pressure chamber 52 is defined by a combination of wirings in the longitudinal and transverse directions; therefore, the number of pressure chambers 52 that can be simultaneously determined is limited, but the number of wirings can be reduced.

Figure 7:
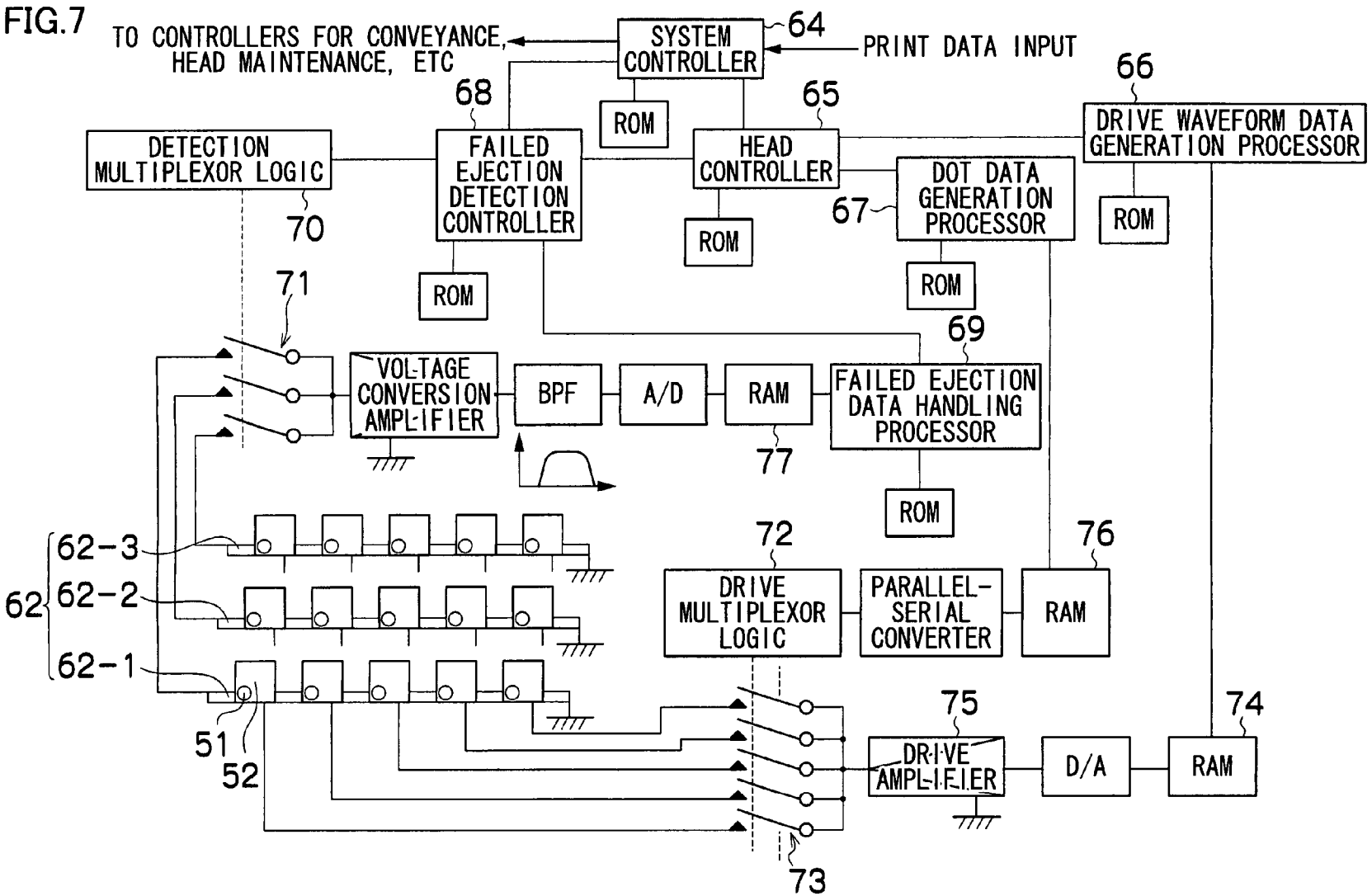
FIG. 7 is a block diagram showing the system configuration of the parts relating to detecting failed ejection in the inkjet recording apparatus of the present embodiment.

FIG. 7 shows a block diagram of the system configuration for the components primarily relating to failed ejection detection in the inkjet recording apparatus 10 of the present embodiment.

As shown in FIG. 7, the inkjet recording apparatus 10 of the present embodiment primarily comprises, as a configuration for preventing failed ejection detections or failed ejections, a system controller 64, a head controller 65, a driving waveform data generation processor 66, a dot data generation processor 67, a failed ejection detection controller 68, a failed ejection data handling processor 69, and the like.

The present embodiment is a print head 50 in which the pressure chambers 52 are arranged in a two-dimensional matrix as shown in FIG. 3, configured such that a thin rod-shaped sensor 62 such as is shown in FIG. 5B is disposed so as to pass through pressure chambers 52 aligned in the direction of the rows (the longitudinal direction of the print head 50), and the plurality of pressure chambers 52 aligned in one row are determined by one rod-shaped sensor 62.

In FIG. 7, for the sake of simplicity, pressure chambers 52 having nozzles 51 aligned in three rows of five each are configured with a rod-shaped sensor 62 (62-1, 62-2, 62-3) arranged through the five pressure chambers 52 in each row, but in actuality, more pressure chambers 52 and rod-shaped sensors 62 are arranged.

When it is determined that an ejection has failed to occur, the ejection piezoelectric elements 58 of the pressure chambers 52 are driven in a pressure determination mode to an extent that ink is not ejected, as will be described in detail later, at which time the ink pressure created in the ink in the pressure chambers 52 is determined by the rod-shaped sensors 62 embedded in the pressure chambers 52, and a failed ejection is thereby detected. At this time, a voltage signal determined by the electrodes in the rod-shaped sensors 62-1, 62-2, and 62-3 in each row is extracted for each row by switching a switching circuit 71 controlled by a detection multiplexor logic 70.

Also, signal lines for sending a drive waveform to the ejection piezoelectric elements 58 (piezo, not shown in FIG. 7, see FIGS. 6A to 6E) that drive the pressure chambers 52 to eject ink are connected to the pressure chambers 52 in each row, and these signal lines are designed to be switched by a switching circuit 73 controlled by the drive multiplexor logic 72.

The system controller 64 receives letters, images, and other such print data from external sources, and controls the head controller 65, the failed ejection detection controller 68, and (not shown in the diagram) a conveyance controller for controlling the conveyance of the recording paper 16, a head maintenance controller for controlling the recovery process when ejection irregularities have occurred in the head, or the like, and the printing routine is controlled.

The head controller 65 instructs a dot data generation processor 67 to create print dots on the basis of instructions and data from the system controller 64, and instructs a drive waveform data generation processor 66 to create a drive waveform for ejecting ink. Also, a notification from the dot data generation processor 67 (described later) for the piezoelectric element that drives the pressure chambers 52 to detect a failed ejection is sent to a failed ejection detection controller 68 described later, and an instruction is issued to vary the resulting dots on the basis of the failed ejection information from the failed ejection detection controller 68.

The drive waveform data generation processor 66 generates a drive waveform for driving the ejection piezoelectric element 58 for forming dots of each size, detecting failed ejections, carrying out maintenance, and preventing ink from volatizing on the nozzle surface according to the instructions from the head controller 65, the temperature and humidity conditions, the conditions of the medium, and the like. This drive waveform data is stored in RAM 74. The drive waveform data stored in the RAM 74 undergoes D/A conversion according to a specific clock signal and is amplified to a specific voltage by a drive amplifier 75, then is switched by the switching circuit 73 and sent to the ejection piezoelectric elements 58 of the pressure chambers 52 that are to be driven.

The term "failed ejection detection waveform" used herein refers to a waveform that drives the ejection piezoelectric elements 58 of the pressure chambers 52 to an extent that ink is not ejected from the nozzles 51 for failed ejection detection, unlike normal ink ejection, whereupon the corresponding ink pressure is determined by the rod-shaped sensor 62, and it is determined an ejection has failed to occur. Thus, the failed ejection detection waveform is a waveform which is suitable for failed ejection detection and which does not cause ink to be ejected. The failed ejection detection waveform is preferably a waveform that differs from the drive waveform during ink ejection, and a suitable example of such a waveform is a sine wave type of waveform at a frequency that resonates according to the size of air bubbles that are likely to affect ejection and to be mixed in the pressure chambers 52. Also, a waveform with a stepping pattern or an impulse pattern may be added as the failed ejection detection waveform, and the entire response of all the pressure chambers 52 may be observed.

The dot data generation processor 67 creates information pertaining to the displacement of dots from letter and image information according to in instruction from the head controller 65. The created dot data is stored in a RAM 76. The dot data stored in the RAM 76 is sent near to the drive element by a signal line with a small amount of data as a result of parallel-serial conversion. Also, the switching circuit 73 is switched by the drive multiplexor logic 72 to send a drive waveform to the ejection piezoelectric elements 58 of the pressure chambers 52 in synchronization with the previously described waveform data in accordance with a specific clock signal.

Also, the dot data generation processor 67 determines which ejection piezoelectric elements 58 of the pressure chambers 52 are to undergo the failed ejection detection operation from the information of the dot arrangement (the state of operation of the ejection piezoelectric elements 58 of the pressure chambers 52), then notifies the head controller 65, and forms dots that are not ejected in accordance with the failed ejection detection waveform generated by the drive waveform data generation processor 66.

The failed ejection detection controller 68 is designed to notify the head controller 65 when the failed ejection detection operation is performed, and failed ejections are detected on the basis of the instruction from the system controller 64 and the information of the ejection piezoelectric elements 58 of the pressure chambers 52 designed to perform operations in which failed ejections from the head controller 65 are detected.

FIG. 7 shows three rows in which five pressure chambers 52 are arranged in each row, but in the present embodiment, common rod-shaped sensors 62 (62-1, 62-2, 62-3) passing through each row of the plurality (five are displayed in FIG. 7) of pressure chambers 52 arranged in rows are disposed as the pressure determination means corresponding to the pressure chambers 52. The output of these rod-shaped sensors 62 is sequentially converted to voltage and amplified when the switching circuit 71 is switched by the detection multiplexor logic 70 controlled by the failed ejection detection controller 68. Low-frequency noise components are then removed by a band pass filter (BPF), the unnecessary high-frequency components that match the sampling frequency of A/D conversion are removed, and the output then undergoes A/D conversion and is stored in memory (RAM) 77.

The failed ejection data handling processor 69 processes the data stored in the memory 77 and determines whether conditions that cause a failed ejection exist. As a result, when pressure chambers 52 and ejection piezoelectric elements 58 are observed to be in a state to cause a failed ejection, the results are sent to the failed ejection detection controller 68.

Figure 8:
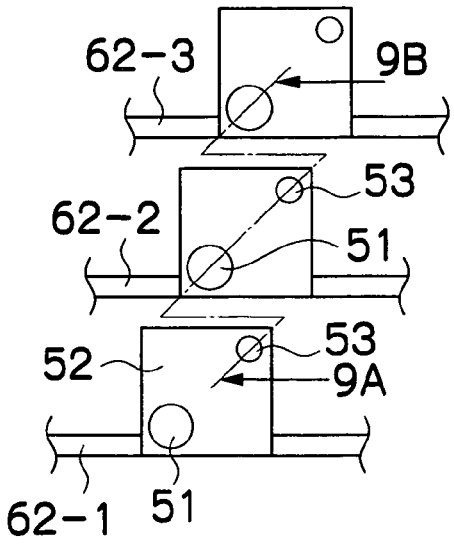
FIG. 8 is an enlarged view showing an enlargement of part of the pressure chambers in FIG. 7.

FIG. 8 shows an enlargement of part of the pressure chambers 52 and rod-shaped sensors 62 (62-1, 62-2, 62-3) shown in FIG. 7. Also, FIG. 9 shows a cross-sectional view along the dashed line 9A-9B in FIG. 8.

Figure 9:
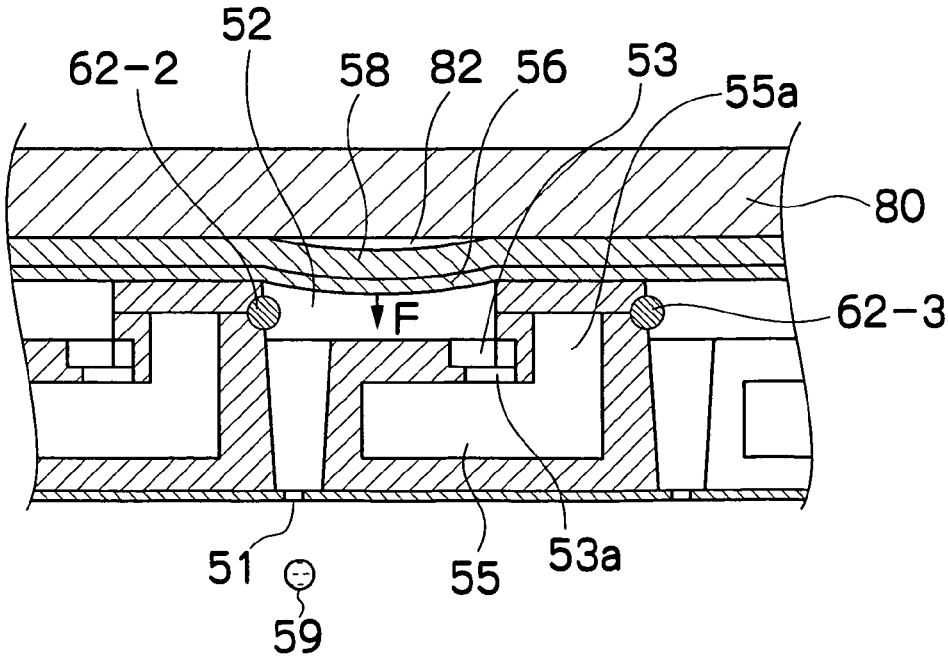
FIG. 9 is a cross-sectional view along the line 9A-9B in FIG. 8.

As shown in FIG. 9, the pressure chambers 52 have ink supply ports 53 for supplying ink to the nozzles 51, and pressure chambers 52 for ejecting ink. FIG. 9 shows a nozzle 51 as having just ejected the ink 59.

The top surface of the pressure chamber 52 is formed from a vibration plate 56, and a piezoelectric element (ejection piezoelectric element) 58 is provided on top of the vibration plate 56. Also, a wiring layer 80 is disposed on the piezoelectric element 58, and though this is not shown in the diagram, wiring is formed from an electrode for driving the piezoelectric element 58.

Applying a voltage to the electrode of the piezoelectric element 58 causes the piezoelectric element 58 to deform, the vibration plate 56 to be pushed down as shown by the arrow F in the diagram, and the capacity of the pressure chamber 52 to be reduced. As a result, the ink 59 is ejected from the nozzle 51. At this time, a space 82 can be formed between the piezoelectric element 58 and the wiring layer 80, and the piezoelectric element 58 readily deforms without any force from the wiring layer 80, and can exert pressure on the vibration plate 56.

Also, a rod-shaped sensor 62 (the rod-shaped sensor 62-2 for the pressure chambers 52 in FIG. 9) is embedded in the inner wall of the pressure chamber 52 near the nozzle 51 so as to pass through the pressure chambers 52 in the direction of the row. Specifically, the sensor is embedded as shown in FIG. 6E previously described. Embedding the sensor near the nozzle 51 in this manner allows ink pressure propagation near the nozzle to be determined and makes it possible to better detect failed ejections.

Also, an ink supply port 53 is provided to the pressure chambers 52 and is designed so that ink is supplied from the ink supply channel 55. A thin supply aperture 53*a* is formed so that the ink in the pressure chambers 52 does not flow back from the ink supply port 53 towards the ink supply channel 55 during ink ejection.

Furthermore, an air bubble trapping part 55*a* is provided above the ink supply channel 55. This allows air bubbles in the ink that has flowed into the ink supply channel 55 to be temporarily retained so as to not enter the pressure chamber 52 from the supply aperture 53*a*. When the original amount of air bubbles dissolved in the ink is small, the air bubbles are absorbed in the ink and removed while retained in the air bubble trapping part 55*a*.

To detect a failed ejection, a plurality of pressure chambers 52 (five pressure chambers 52 for each row) are determined by one sensor (the rod-shaped sensors 62-1, 62-2, 62-3), as shown in FIG. 7. The determination can be performed for each pressure chamber 52 if the electrodes for determining the voltage from the rod-shaped sensors 62 are provided separately to drive each of the pressure chambers 52, but this arrangement is disadvantageous due to the large number of wires.

In the present embodiment, as shown in FIG. 7, a common electrode is used in the rod-shaped sensors 62 (62-1, 62-2, 62-3) in each row, the switching circuit 73 is switched by the drive multiplexor logic 72, a time difference is formed, and the pressure chambers 52 in each row are driven, whereby it is possible to differentiate between the voltage signals of the pressure chambers 52 in each row, and each row is determined sequentially by the detection multiplexor logic 70, whereby failed ejections and other such irregularities are detected.

The piezoelectric element 58 (ejection piezoelectric element) is driven during determination by a waveform for failed ejection detection that does not eject ink in order to determine the ink pressure, separately from the normal ink ejection as previously described, and since the ejection piezoelectric element 58 for driving the pressure chamber 52 to eject ink and the determination piezoelectric element (the determination piezoelectric element 62*a* of the rod-shaped sensor 62 in this case) are separate, there are few limits such as those found in the related art, and driving may be equivalent to the driving during ink ejection.

Specifically, it has been described above that during failed ejection detection, driving for ink pressure determination is performed wherein the ink is not ejected, which is different from normal ink ejection, but it is also possible to determine the ink pressure during driving that involves normal ink ejection. In this case, it is determined whether the pressure is abnormally low or abnormally high compared to a specific pressure signal that should be normally determined during normal ink ejection.

An abnormally low ink pressure detected during normal ejection is believed to be because the pressure is absorbed by the air bubbles, and an abnormally high pressure is believed to be because the ink has a high viscosity and the nozzle 51 is clogged.

Also, as previously described, when driving that involves detecting failed ejections is performed, the drive waveform is preferably different from the drive waveform during ink ejection. As previously described, this waveform is preferably a sine wave type of waveform at a frequency that resonates according to the size of air bubbles that are likely to affect ejection and to be mixed in the pressure chambers 52.

In this manner, the ink pressure in the pressure chambers 52, the resonance points, and the like are determined by the pressure determination means embedded in the print head 50 (the inside-head failed ejection detection unit; the rod-shaped sensors 62 embedded in the inner wall near the nozzles 51 of the pressure chambers 52 in the present embodiment), and whether the ink 59 is ejected normally is determined by the failed ejection detection means. Since the nozzles 51 are alternating between a state of ejecting ink and a state of not ejecting according to the image data even during printing, driving that involves detecting failed ejections can be performed to detect failed ejections while ink is not ejected. Also, sometimes it is possible to determine the ink pressure during normal ink ejection as described above, and failed ejection detection can be performed during printing. However, although failed ejections can be detected by performing failed ejection detection with the inside-head failed ejection detection unit, it is difficult during ejection to detect irregularities such as the curving of the direction in which the ink is flying.

In view of this, in the present embodiment, the outside-head failed ejection detection unit 24 is disposed outside of the print head 50 as previously described in addition to the inside-head failed ejection detection unit embedded in the print head 50, and is designed to detect the ink (the ink in midair or the ink deposited on the recording paper 16) immediately after ink ejection. In the present embodiment, the precision of detection is improved by using both the inside-head failed ejection detection unit and the outside-head failed ejection detection unit. Also, using both these units makes it possible to perform determination in real time and to determine curves in the ink path and other such irregularities.

Figure 10:
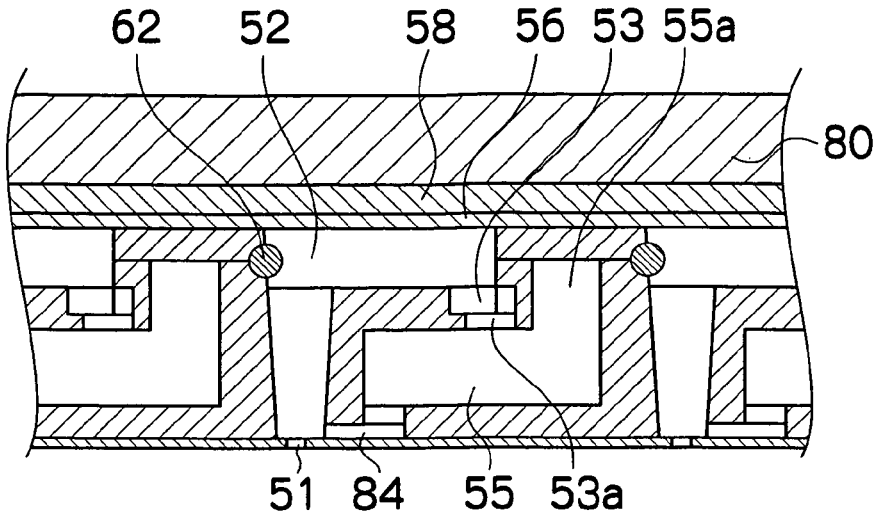
FIG. 10 is a cross-sectional view showing another example for FIG. 9.

FIG. 10 shows another example of the present embodiment. The example shown in FIG. 10 is substantially the same as the example shown in FIG. 9 previously described, but is different in that an ink circulation channel 84 for circulating ink from the vicinity of the opening of the nozzle 51 towards the ink supply channel 55 is provided.

This ink circulation channel 84 is a thin space that joins the vicinity of the opening of the nozzle 51 with the ink supply channel 55, wherein the force for pushing out the ink from the nozzle 51 during ink ejection acts to push out the ink from the nozzle 51 and also functions to slowly circulate the ink by returning a small amount of ink towards the ink circulation channel 84.

Also, the vibration plate 56 is not suddenly displaced to push out ink as in ink ejection, and when the ink is slowly pushed out, the tensile strength of the ink surface that acts on the meniscus surface of the ink is stronger than the pressure pushing on the ink, so instead of the ink being expelled from the nozzle 51, the ink returns from the ink circulation channel 84 to the ink supply channel 55, and repeating this process stirs the ink in the nozzle 51 and has the effect of preventing the ink from increasing in viscosity.

Otherwise, the structural elements are similar to those in FIG. 9, and detailed descriptions are omitted by using the same numerals.

Figure 11:
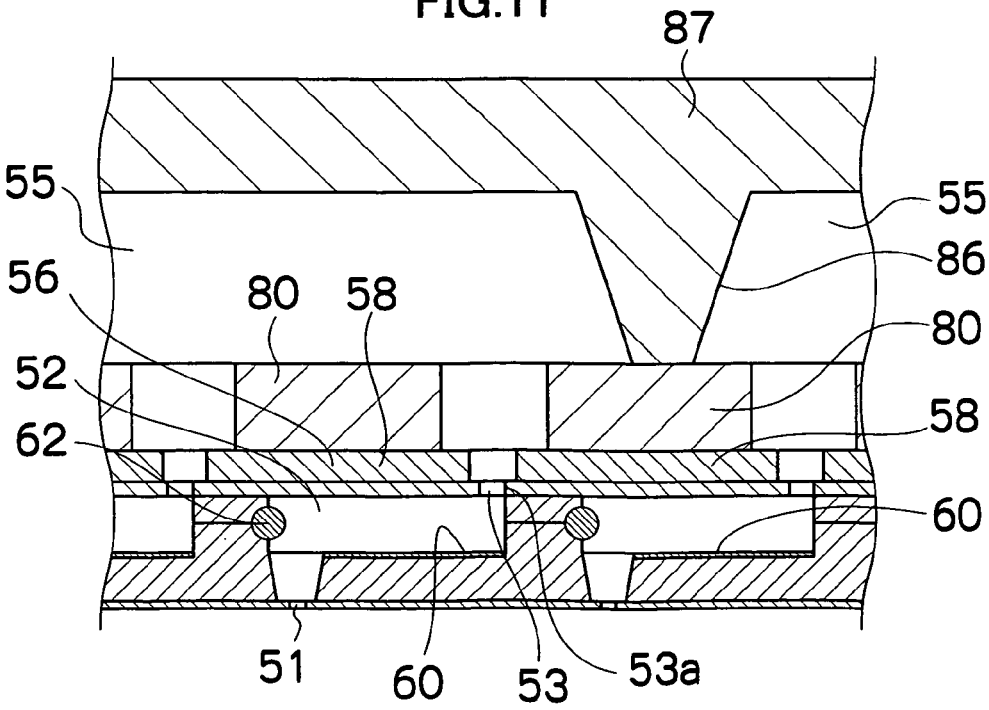
FIG. 11 is likewise a cross-sectional view showing another example for FIG. 9.

FIG. 11 shows another example. In the example shown in FIG. 11, the ink supply channel 55 is disposed higher up than the piezoelectric element 58. Specifically, in FIG. 11, the piezoelectric element 58 is disposed on the vibration plate 56 that forms the top surface of the pressure chamber 52, the wiring layer 80 is formed on the piezoelectric element 58, a structural member 87 supported by a head fixing support 86 is formed thereon, and the space between the structural member 87 and the wiring layer 80 constitutes the ink supply channel 55.

The wiring layer 80, the piezoelectric element 58, and the vibration plate 56 are each provided with holes for supplying ink from the ink supply channel 55 to the pressure chamber 52, which separates the head into three stages in the direction of the pressure chamber 52 and ensures that the ink flows into the pressure chamber 52 from the ink supply port 53 provided to the vibration plate 56 on top of the pressure chamber 52. Also, an ink supply aperture 53*a* is formed so that the portion with the ink supply port 53 is particularly thin.

In this example, as a result of the ink supply channel 55 being disposed on top of the piezoelectric element 58, there is no need to provide a space for arranging the ink supply channel 55 on the underside of the pressure chamber 52 as in the examples shown in FIGS. 9 and 10; therefore, the distance from the pressure chamber 52 to the nozzle can be shortened. Thus, the volume of the flow path between the pressure chamber 52 and the nozzle 51 is reduced by shortening the distance from the pressure chamber 52 to the nozzle 51, and the responsiveness is improved.

Also, in this example, the rod-shaped sensor 62 is embedded in the inner wall of the pressure chamber 52 near the nozzle 51, and the flat plate-shaped sensor 60 is disposed on the surface on which the nozzle 51 is formed on the bottom of the pressure chamber 52.

Thus, the precision with which pressure is determined can be improved by disposing two pressure determination units, but only one of either of these pressure determination units may be used.

When one flat plate-shaped sensor 60 as pressure determination means is disposed so as to include the plurality of pressure chambers 52 arranged in a two-dimensional matrix pattern in either the entire print head 50, as shown in FIG. 5A, for example, or in one area on the print head 50, then it is possible to perform determination by indicating addresses in the longitudinal and transverse directions in each of the areas with the piezoelectric elements (determination piezoelectric elements 60*a* in the flat plate-shaped sensor 60) in correspondence with the pressure chambers 52.

Figure 12:
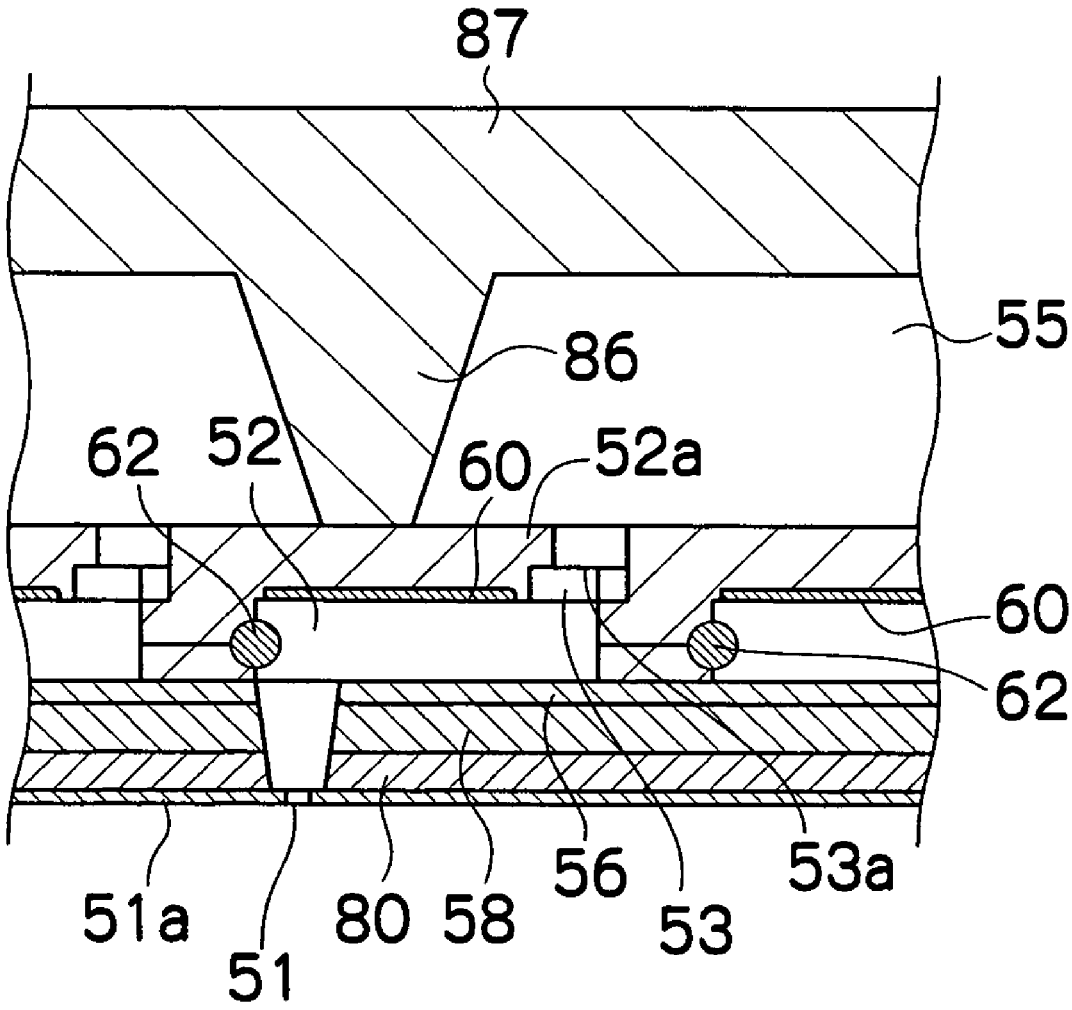
FIG. 12 is likewise a cross-sectional view showing yet another example for FIG. 9.

FIG. 12 shows yet another example. This is another embodiment of the example shown in FIG. 11 and is similar to the example in FIG. 11 in that the ink supply channel 55 is disposed higher up than the pressure chamber 52, but is different in that the piezoelectric element 58 (for ejection) is disposed lower than the pressure chamber 52.

Specifically, in the example shown in FIG. 12, the vibration plate 56, the piezoelectric element 58, and the wiring layer 80 are disposed from the pressure chamber 52 towards a nozzle plate 51*a* between the pressure chamber 52 and the nozzle plate 51*a* on which the nozzle 51 is formed.

Ink is supplied to the pressure chamber 52 from the ink supply channel 55 formed on the top surface 52*a* of the pressure chamber 52 by the head fixing support 86 and the structural member 87, via the ink supply aperture 53*a* and the ink supply port 53 formed on the top surface 52*a* of the pressure chamber 52.

Also, the rod-shaped sensor 62 is embedded in the inner wall of the pressure chamber 52 near the nozzle 51 as pressure determination means, and the flat plate-shaped sensor 60 is embedded in the top surface of the pressure chamber 52. In this case, either one of these sensors alone may also be used.

In this example, the distance from the pressure chamber 52 to the nozzle 51 is greater than in the example shown in FIG. 11, but is shorter than in the examples shown in FIG. 9 or FIG. 10.

According to the present embodiment as described above, since a pressure-determining piezoelectric element is disposed separately from the ink-ejecting piezoelectric element, it is possible to detect failed ejections without relying on the timing of the drive signal of the ejection piezoelectric element, and the optimum material in terms of determination sensitivity in the pressure determination means can be selected for the ejection piezoelectric element.

Also, since a plurality of pressure chambers are determined with one sensor, it is possible to improve the assembly, precision, and reliability of the apparatus.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a plurality of nozzles;

a plurality of individual liquid supply channels each of which is communicated with a corresponding one of the plurality of nozzles and supplies a liquid to the corresponding one of the plurality of nozzles, the plurality of individual liquid supply channels including a plurality of pressure chambers corresponding to the plurality of nozzles, respectively, each pressure chamber being defined by four walls forming substantially a rectangular shape and a top and bottom surface, where said corresponding nozzle and liquid supply channel are located diagonally from each other at opposite sides of the pressure chamber;

a plurality of drive elements each of which applies pressure in the liquid in a corresponding one of the individual liquid supply channels so as to eject the liquid as a droplet from the corresponding one of the plurality of nozzles;

at least one pressure determination device which is arranged through the plurality of individual liquid supply channels and determines a pressure of the liquid in each of the pressure chambers applied by a corresponding one of the plurality of drive elements, the pressure determination device being separated from the plurality of drive elements; and a failed ejection detection device which detects failed ejection of the droplet from each of the plurality of individual liquid supply channels according to the pressure determined by the pressure determination device.

2. The image forming apparatus as defined in claim 1, wherein the pressure determination device includes a rod-shaped pressure determination sensor configured from a piezoelectric element, the rod shaped pressure determination sensor being positioned in the wall of the pressure chamber adjacent the nozzle.

3. The image forming apparatus as defined in claim 1, wherein the pressure determination device determines the pressure of the liquid applied by each of the plurality of drive elements being driven with a specific waveform.

4. The image forming apparatus as defined in claim 3, wherein the specific waveform is a substantially sinusoidal waveform at a frequency that resonates according to the size of air bubbles affecting liquid ejection from the plurality of individual liquid supply channels.

5. The image forming apparatus as defined in claim 1, further comprises:

a common liquid supply channel;

a plurality of liquid supply ports, each of which is arranged between the common liquid supply channel and a corresponding one of the plurality of individual liquid supply channels and each of which includes an opening smaller than the common liquid supply channel and the corresponding one of the plurality of individual liquid supply channels, wherein the liquid is supplied from the common liquid supply channel to the plurality of nozzles through the plurality of liquid supply ports and the plurality of individual liquid supply channels.

6. The image forming apparatus as defined in claim 1, wherein a plurality of the pressure determination devices are arranged through the plurality of pressure chambers, each of the pressure determination devices encompassing at least two of the pressure chambers and detecting the pressure of the liquid in the at least two of the pressure chambers.

7. The image forming apparatus as defined in claim 6, wherein:

the plurality of pressure chambers are arranged two-dimensionally in rows and in columns;

a first group of the pressure determination devices extend in a direction of the rows of the pressure chambers, each of the first group of the pressure determination devices being arranged through one of the rows of the pressure chambers; and a second group of the pressure determination devices extend in a direction of the columns of the pressure chambers, each of the second group of the pressure determination devices being arranged through one of the columns of the pressure chambers.

8. The image forming apparatus as defined in claim 6, wherein:

the plurality of pressure chambers are arranged substantially in rows; and the plurality of pressure determination devices extend in a direction of the rows of the pressure chambers, each of the pressure determination devices being arranged through one of the rows of the pressure chambers.

9. An image forming apparatus, comprising:

a plurality of nozzles;

a plurality of individual liquid supply channels each of which is communicated with a corresponding one of the plurality of nozzles and supplies a liquid to the corresponding one of the plurality of nozzles, the plurality of individual liquid supply channels including a plurality of pressure chambers corresponding to the plurality of nozzles, respectively, each pressure chamber being defined by four walls forming substantially a rectangular shape and a top and bottom surface, where said corresponding nozzle and liquid supply channel are located diagonally from each other at opposite sides of the pressure chamber;

a plurality of drive elements each of which applies pressure in the liquid in a corresponding one of the individual liquid supply channels so as to eject the liquid as a droplet from the corresponding one of the plurality of nozzles;

at least one pressure determination device which is arranged through the plurality of individual liquid supply channels and determines a pressure of the liquid in each of the pressure chambers applied by a corresponding one of the plurality of drive elements, the pressure determination device being separated from the plurality of drive elements;

an individual signal extraction device which is operatively connected to the pressure determination device and extracts a pressure determination result from the pressure determination device for each of the plurality of individual liquid supply channels; and a failed ejection detection device which detects failed ejection of the droplet from each of the plurality of individual liquid supply channels according to the pressure determination result determined for a corresponding one of the plurality of individual liquid supply channels.

10. The image forming apparatus as defined in claim 9, wherein the pressure determination device includes a rod-shaped pressure determination sensor configured from a piezoelectric element.

11. The image forming apparatus as defined in claim 9, wherein the pressure determination device determines the pressure of the liquid applied by each of the plurality of drive elements being driven with a specific waveform.

12. The image forming apparatus as defined in claim 11, wherein the specific waveform is a substantially sinusoidal waveform at a frequency that resonates according to the size of air bubbles affecting liquid ejection from the plurality of individual liquid supply channels.

13. The image forming apparatus as defined in claim 9, wherein the individual signal extraction device includes a common electrode to the plurality of individual liquid supply channels and a plurality of individual electrodes each corresponding to one of the plurality of individual liquid supply channels.

14. The image forming apparatus as defined in claim 9, wherein a plurality of the pressure determination devices are arranged through the plurality of pressure chambers, each of the pressure determination devices encompassing at least two of the pressure chambers and detecting the pressure of the liquid in the at least two of the pressure chambers.

15. The image forming apparatus as defined in claim 14, wherein:

the plurality of pressure chambers are arranged two-dimensionally in rows and in columns;

a first group of the pressure determination devices extend in a direction of the rows of the pressure chambers, each of the first group of the pressure determination devices being arranged through one of the rows of the pressure chambers; and a second group of the pressure determination devices extend in a direction of the columns of the pressure chambers, each of the second group of the pressure determination devices being arranged through one of the columns of the pressure chambers.

16. The image forming apparatus as defined in claim 14, wherein:

the plurality of pressure chambers are arranged substantially in rows; and the plurality of pressure determination devices extend in a direction of the rows of the pressure chambers, each of the pressure determination devices being arranged through one of the rows of the pressure chambers.

17. An image forming apparatus, comprising:

a plurality of nozzles;

a plurality of individual liquid supply channels each of which is communicated with a corresponding one of the plurality of nozzles and supplies a liquid to the corresponding one of the plurality of nozzles, the plurality of individual liquid supply channels including a plurality of pressure chambers corresponding to the plurality of nozzles, respectively, each pressure chamber being defined by four walls forming substantially a rectangular shape and a top and bottom surface, where said corresponding nozzle and liquid supply channel are located diagonally from each other at opposite sides of the pressure chamber;

a plurality of drive elements each of which applies pressure in the liquid in a corresponding one of the individual liquid supply channels so as to eject the liquid as a droplet from the corresponding one of the plurality of nozzles;

a drive control device which controls a timing at which each of the plurality of drive elements is driven for the corresponding one of the individual liquid supply channels;

at least one pressure determination device which is arranged through the plurality of individual liquid supply channels and determines a pressure of the liquid in each of the pressure chambers applied by the corresponding one of the plurality of drive elements, the pressure determination device being separated from the plurality of drive elements; and a failed ejection detection device which detects failed ejection of the droplet from each of the plurality of individual liquid supply channels according to the pressure determined by the pressure determination device, wherein the plurality of drive elements are driven with time differences with respect to each other by the drive control device, and the failed ejection is detected for a corresponding one of the individual liquid supply channels by the failed ejection detection device according to a pressure determination result obtained by the pressure determination device and extracted for the corresponding one of the individual liquid supply channels based on the time differences with respect to each of the drive elements.

18. The image forming apparatus as defined in claim 17, further comprising an outside-head failed ejection detection device which detects the ejected droplet.

19. The image forming apparatus as defined in claim 17, wherein the pressure determination device includes a rod-shaped pressure determination sensor configured from a piezoelectric element, the rod shaped pressure determination sensor being positioned in the wall of the pressure chamber adjacent the nozzle.

20. The image forming apparatus as defined in claim 17, wherein the pressure determination device determines the pressure of the liquid applied by each of the plurality of drive elements being driven with a specific waveform.

21. The image forming apparatus as defined in claim 20, wherein the specific waveform is a substantially sinusoidal waveform at a frequency that resonates according to the size of air bubbles affecting liquid ejection from the plurality of individual liquid supply channels.

22. The image forming apparatus as defined in claim 17, wherein a plurality of the pressure determination devices are arranged through the plurality of pressure chambers, each of the pressure determination devices encompassing at least two of the pressure chambers and detecting the pressure of the liquid in the at least two of the pressure chambers.

23. The image forming apparatus as defined in claim 22, wherein:

the plurality of pressure chambers are arranged two-dimensionally in rows and in columns;

a first group of the pressure determination devices extend in a direction of the rows of the pressure chambers, each of the first group of the pressure determination devices being arranged through one of the rows of the pressure chambers; and a second group of the pressure determination devices extend in a direction of the columns of the pressure chambers, each of the second group of the pressure determination devices being arranged through one of the columns of the pressure chambers.

24. The image forming apparatus as defined in claim 22, wherein:

the plurality of pressure chambers are arranged substantially in rows; and the plurality of pressure determination devices extend in a direction of the rows of the pressure chambers, each of the pressure determination devices being arranged through one of the rows of the pressure chambers.

25. An image forming method, comprising steps of:

supplying a liquid to a plurality of nozzles from a plurality of individual liquid supply channels each of which is communicated with a corresponding one of the plurality of nozzles, the plurality of individual liquid supply channels including a plurality of pressure chambers corresponding to the plurality of nozzles, respectively, each pressure chamber being defined by four walls forming substantially a rectangular shape and a top and bottom surface, where said corresponding nozzle and liquid supply channel are located diagonally from each other at opposite sides of the pressure chamber;

applying pressure in the liquid in one of the individual liquid supply channels so as to eject the liquid as a droplet from the corresponding one of the plurality of nozzles;

determining a pressure of the liquid in each of the pressure chambers applied by a corresponding one of a plurality of drive elements being driven in a pressure determination mode to apply a pressure that is insufficient to eject liquid as a droplet from the corresponding one of the plurality of nozzles, the pressure of the liquid in each of the pressure chambers being determined by means of at least one pressure determination device which is arranged through the plurality of individual liquid supply channels;

extracting a pressure determination result for each of the pressure chambers; and detecting failed ejection of the droplet from each of the plurality of individual liquid supply channels according to the pressure determination result.

26. The image forming method as defined in claim 25, wherein the step of determining a pressure includes determining the pressure of the liquid applied by each of the plurality of drive elements being driven with a specific waveform.

27. The image forming method as defined in claim 26, wherein the specific waveform is a substantially sinusoidal waveform at a frequency that resonates according to the size of air bubbles affecting liquid ejection from the plurality of individual liquid supply channels.

28. The image forming method as defined in claim 25, wherein in the determining step, the pressure of the liquid in each of the pressure chambers is determined by means of a plurality of the pressure determination devices which are arranged through the plurality of pressure chambers, each of the pressure determination devices encompassing at least two of the pressure chambers and determining the pressure of the liquid in the at least two of the pressure chambers.

* * * * *